US010054117B2

(12) United States Patent
Gerz et al.

(10) Patent No.: US 10,054,117 B2
(45) Date of Patent: Aug. 21, 2018

(54) DOSING PUMP UNIT AND METHOD FOR CONTROLLING A DOSING PUMP UNIT

(75) Inventors: Sergei Gerz, Pfinztal (DE); Valeri Kechler, Pforzheim (DE); Markus Simon, Dobel (DE)

(73) Assignee: Grundfos Management a/s, Bjerringbro (DK)

( * ) Notice: Subject to any disclaimer, the term of this patent is extended or adjusted under 35 U.S.C. 154(b) by 1068 days.

(21) Appl. No.: 13/579,719

(22) PCT Filed: Feb. 16, 2011

(86) PCT No.: PCT/EP2011/000722

§ 371 (c)(1),
(2), (4) Date: Oct. 2, 2012

(87) PCT Pub. No.: WO2011/101119

PCT Pub. Date: Aug. 25, 2011

(65) Prior Publication Data

US 2013/0202454 A1 Aug. 8, 2013

(30) Foreign Application Priority Data

Feb. 18, 2010 (EP) ..... 10001643

(51) Int. Cl.
*F04B 49/00* (2006.01)
*F04B 43/00* (2006.01)
*F04B 49/06* (2006.01)

(52) U.S. Cl.
CPC ..... *F04B 49/00* (2013.01); *F04B 43/0081* (2013.01); *F04B 49/06* (2013.01)

(58) Field of Classification Search
CPC ..... F04B 13/00; F04B 43/0081; F04B 49/00; F04B 49/06; F04B 2201/0202;
(Continued)

(56) References Cited

U.S. PATENT DOCUMENTS 4,131,393 A 12/1978 Magnussen, Jr.
4,255,088 A * 3/1981 Newton ..... A61M 5/365 417/1

(Continued)

FOREIGN PATENT DOCUMENTS

DE 27 59 056 A1 7/1978
DE 38 01 157 A1 8/1989

(Continued)

*Primary Examiner* — Devon Kramer
*Assistant Examiner* — Joseph Herrmann
(74) *Attorney, Agent, or Firm* — McGlew and Tuttle, P.C.

(57) ABSTRACT

A metering pump aggregate has a metering chamber (16), adjoined by a positive-displacement body (14) that can be moved by a positive-displacement drive (6), as well as a controller (26) for actuating the positive-displacement drive (6). The controller (26) is designed to actuate the positive-displacement drive (6) in such a way, at least for specific setpoint conveyed flows to be generated by the metering pump, that a stroke of the positive-displacement body (14) begins with a first, elevated stroke rate (n1), and is subsequently continued at a second, lower stroke rate (n2). A method for controlling such a metering pump aggregate is also provided.

13 Claims, 2 Drawing Sheets

(58) Field of Classification Search
CPC ..... F04B 2201/0602; F04B 2201/0601; F04B 2203/0209; F04B 2203/0409; F04B 2207/041–2207/0413
See application file for complete search history.

(56) References Cited

U.S. PATENT DOCUMENTS 4,359,312 A * 11/1982 Funke ..... F04B 11/0058 417/18
4,396,385 A * 8/1983 Kelly ..... A61M 5/172 128/DIG. 12
4,448,692 A * 5/1984 Nakamoto ..... B01D 15/14 210/101
4,470,758 A * 9/1984 Pazemenas ..... G01P 3/489 417/63
4,474,309 A * 10/1984 Solomon ..... A61M 5/14224 222/1
4,604,034 A * 8/1986 Wheeldon ..... A61M 5/172 417/18
4,681,513 A * 7/1987 Saito ..... F04B 1/02 417/18
5,047,950 A * 9/1991 Fritsch ..... G01F 3/20 702/47
5,056,036 A * 10/1991 Van Bork ..... F04B 49/065 417/14
5,249,932 A * 10/1993 Van Bork ..... F04B 43/0081 417/385
8,267,667 B2 9/2012 Freudenberger et al.
2007/0040454 A1* 2/2007 Freudenberger ..... F04B 17/042 310/12.04

FOREIGN PATENT DOCUMENTS

DE 195 25 557 A1 1/1997
DE 60106594 T2 11/2005
DE 20 2005 013090 U1 1/2007
DE 102005039772 A1 3/2007
EP 1 278 961 B1 10/2004
WO 03/054392 A1 7/2003

* cited by examiner

DOSING PUMP UNIT AND METHOD FOR CONTROLLING A DOSING PUMP UNIT

CROSS REFERENCE TO RELATED APPLICATIONS

This application is a United States National Phase application of International Application PCT/EP2011/000722 and claims the benefit of priority under 35 U.S.C. § 119 of European Patent Application EP 10 001 643.5 filed Feb. 18, 2010, the entire contents of which are incorporated herein by reference.

FIELD OF THE INVENTION

The invention relates to a metering pump aggregate (metering pump assembly) with a metering chamber, a positive-displacement body that can be moved by a positive-displacement drive, as well as a controller for actuating the positive-displacement drive.

BACKGROUND OF THE INVENTION

Known metering pump aggregates have a metering chamber, which is bordered on one side by a positive-displacement body, for example in the form of a membrane. The positive-displacement body can change the metering chamber, thereby achieving a pumping effect. A suitable linear drive is provided for driving the positive-displacement body. For example, this can be a rotationally driving drive motor in form of a stepping motor, which imparts a linearly oscillating motion to a connecting rod by way of a cam. Arranged on the input and output side of the metering chamber are check valves, which during an intake stroke prevent the medium to be conveyed from flowing out of the pressure line back into the metering chamber, and during the pressure stroke prevent the medium from being forced into the intake line instead of the pressure line.

When metering very low volumes or conveyed flows, for example a few milliliters per hour, very slow stroke rates are required; for example a pressure stroke can require several minutes, even longer than fifteen minutes. At these very slow stroke and conveying rates, the lack of dynamics makes it impossible to ensure that the valves will close faster, which leads to leaks, and hence poor metering accuracy.

SUMMARY OF THE INVENTION

In view of this difficulty, an object of the invention is to provide a metering pump aggregate that ensures a high metering accuracy, even at very low volumes to be metered.

The metering pump aggregate according to the invention has a known metering chamber, which is bordered by a positive-displacement body. Therefore, the positive-displacement body forms a wall of the metering chamber, and its motion can change the volume of the metering chamber. The volume of the metering chamber increases during an intake stroke, and the positive-displacement body is moved during a pressure stroke in such a way that the volume of the metering chamber diminishes. Provided to move the positive-displacement body is a positive-displacement drive, which can be controlled or regulated by way of a controller. The controller makes it possible in particular to set the speed, operating duration and direction of motion of the positive-displacement drive, so as to adjust or regulate the volume to be metered by actuating the positive-displacement drive.

The positive-displacement drive is preferably an electric drive motor, in particular a stepping motor, which can be very precisely actuated to specifically set the stroke length and/or stroke rate of the positive-displacement body so as to keep the quantity to be metered and the metering rate within the prescribed values.

The drive motor can be a linear motor or rotationally driving electric motor, wherein the rotational motion is then converted into a linear motion of the positive-displacement body by means of suitable gearing means, for example a crankshaft drive, a cam drive, a cam or spindle. An EC motor, a servomotor, or another suitable electric drive motor can also be used as the drive motor in place of the stepping motor.

According to the invention, the controller and positive-displacement drive are designed in such a way that the traversing rate of the positive-displacement body can be changed even during a stroke, for example during a pressure stroke or intake stroke. This is done by changing the velocity of the positive-displacement drive, e.g. the speed or rotational velocity of the drive motor. The controller is here further designed in such a way that it selects a special traversing or drive characteristic of the positive-displacement drive for specific setpoint conveyed flows to be generated by the metering pump, and actuates the positive-displacement drive accordingly. According to the invention, such a special drive characteristic is designed in such a way that the stroke of the positive-displacement body is initiated with a first, elevated stroke rate, and subsequently continued with a second, lower stroke rate. Since the stroke starts with an elevated stroke rate, a stronger pulse or fast pressure rise is exerted on the medium to be conveyed or fluid to be conveyed at the beginning of the stroke, causing the check valve to close fast. The stroke rate is then reduced by correspondingly actuating of the positive-displacement drive, and the remainder of the stroke is completed at a lower stroke or traversing rate of the positive-displacement body. As a result, only a low volume per unit of time is conveyed in the entire stroke, despite the elevated stroke rate at the start of the stroke. Thus, this special drive characteristic is suitable in particular for conveying very low volume flows, at which there is the aforementioned problem of unreliable, immediate closure of the check valves.

The controller is preferably designed in such a way to actuate the positive-displacement drive, e.g. a drive motor, in such a way, at least for specific conveyed flows to be generated by the metering pump, that a pressure stroke of the positive-displacement body is begun at a first, elevated stroke rate, and then continued at the second, lower stroke rate. Thereby it is achieved that the check valve is quickly and reliably closed toward the intake channel given a pressure stroke for especially low conveyed flows, so that there arise none or only little leaks arise there, and hence a high metering accuracy is achieved even at low conveyed flows. After the initial pulse due to the elevated stroke rate then causes the controller to reduce the stroke rate by decreasing the velocity of the positive-displacement drive, i.e., for example the speed of the drive motor, so that only a low overall conveyed volumetric flow is reached during the stroke.

Even if the controller is designed in a preferred embodiment in such a way as to implement the special drive characteristics described above and below during a pressure stroke, it must be understood that the controller can also be designed to alternatively or additionally execute the special drive strategy described above or below during an intake stroke.

Preferably, the controller is designed in such a way to actuate the positive-displacement drive in such a way for conveyed flows below a predetermined limit that a stroke of the positive-displacement body begins with a first, elevated stroke rate, and then continues at a second, lower stroke rate. The precise limit can depend on the structural configuration of the metering chamber, and in particular of the used check valves. Given such low conveyed volumetric flows, at which the valves are no longer reliably closed, the described special traversing characteristics of the positive-displacement body are intended to be used, in which the initial stroke rate can be elevated, after which the stroke is continued with a stroke rate that is reduced by comparison with this elevated stroke rate. The corresponding specific limits are preset for the controller, and stored in the controller memory.

As described, the stroke rate of the positive-displacement drive is changed through corresponding actuation by means of the controller, so that the positive-displacement drive can be operated at varying velocities or speeds based on controller settings. When using a stepping motor, the motor can perform a predetermined number of individual steps in a specific time interval. The number of individual steps per time interval can be variably prescribed by the controller to change the speed of the drive motor.

It is further preferred that the controller be designed in such a way that the first, elevated stroke rate is set faster than required for a setpoint conveyed flow. Thereby, a fast initial pressure rise is exerted on the medium to be conveyed by comparison to the initial, fast pressure rise, which would otherwise be encountered at the stroke rate required for the setpoint conveyed flow, thereby causing the valves to reliably close, in particular the valve in the intake channel. To achieve this, the stroke rate must be selected for a conveyed flow that is actually higher at the start of the stroke. The later reduction in stroke rate then compensates for the latter again, so as to achieve an overall lower conveyed flow throughout the entire stroke than is reached at the beginning of the stroke at the higher stroke rate.

It is here further preferred that the controller be designed in such a way that the second, lower stroke rate be adjusted to be slower than required for a setpoint conveyed flow. Thereby, the setpoint conveyed flow can be reached on average throughout the entire stroke, in conjunction with the stroke rate chosen at the beginning of the stroke, which is higher than required for the setpoint conveyed flow. It is especially preferred that the controller be designed to select or calculate the first, elevated stroke rate and second, reduced stroke rate, along with the duration of the partial stroke with the first stroke rate, as a function of a prescribed setpoint conveyed flow, in such a way that an average conveyed flow reflecting the desired setpoint conveyed flow is achieved. The duration for which the stroke rates remain elevated during the stroke and the absolute values for the higher and comparatively reduced stroke rate can be stored in a controller memory for specific setpoint conveyed volumetric flows, or be calculated and updated for a selected setpoint conveyed volumetric flow based on preset algorithms. In addition, the volumetric flow can also be monitored using suitable sensors during the stroke, so that the controller could also regulate the stroke rate to a specific setpoint value even during the stroke.

In a preferred embodiment, 2% or more of the entire stroke is performed at the first, elevated stroke rate. It is further preferred that less than 20% of the entire stroke be performed at the first, elevated stroke rate. The stroke need not be the maximum possible stroke, and it can also rather be just a shortened stroke. As a consequence, this only represents a small portion of the entire stroke, so that the constant metering of the medium to be metered is only slightly impaired by the elevated stroke rate at the beginning of the stroke. However, since the poor closing quality of the valves would otherwise lead to undesired leaks at a low conveyed volumetric flow at the beginning of the stroke without this elevated stroke rate, and hence to a deterioration in metering accuracy, the elevated stroke rate at the beginning of the stroke yields a higher overall metering accuracy.

The change in stroke rate from the first, elevated stroke rate to the second, lower stroke rate can take place suddenly, or also happen in the form of a ramp. It is also possible for the change to occur in several steps or stages, or over a ramp with changing gradients. It is further preferred that the first, elevated stroke rate be greater than or equal to six strokes per minute, while the second, smaller stroke rate preferably measure less than six strokes per minute. It can further be preferred that the first, elevated stroke rate essentially correspond to the stroke rate in the intake stroke. It is best for the first, elevated stroke rate be several times greater than the second, lower stroke rate, wherein the first elevated stroke rate preferably measures three times, and in another preferred embodiment five times or seven times or more, as much as the second, lower stroke rate.

The invention further relates to a method for controlling a metering pump aggregate, wherein the method provides that the stroke of a positive-displacement body be designed in such a way that the stroke be started with a first, elevated stroke rate, and continued thereafter with a second, lower stroke rate. The stroke can be a pressure or intake stroke. This method is preferably used for setpoint conveyed flows under a preset limit. Otherwise, the method is preferably designed as specified in the preceding description of the operation of the metering pump aggregate according to the invention.

In the following, the invention will be described using examples based on the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
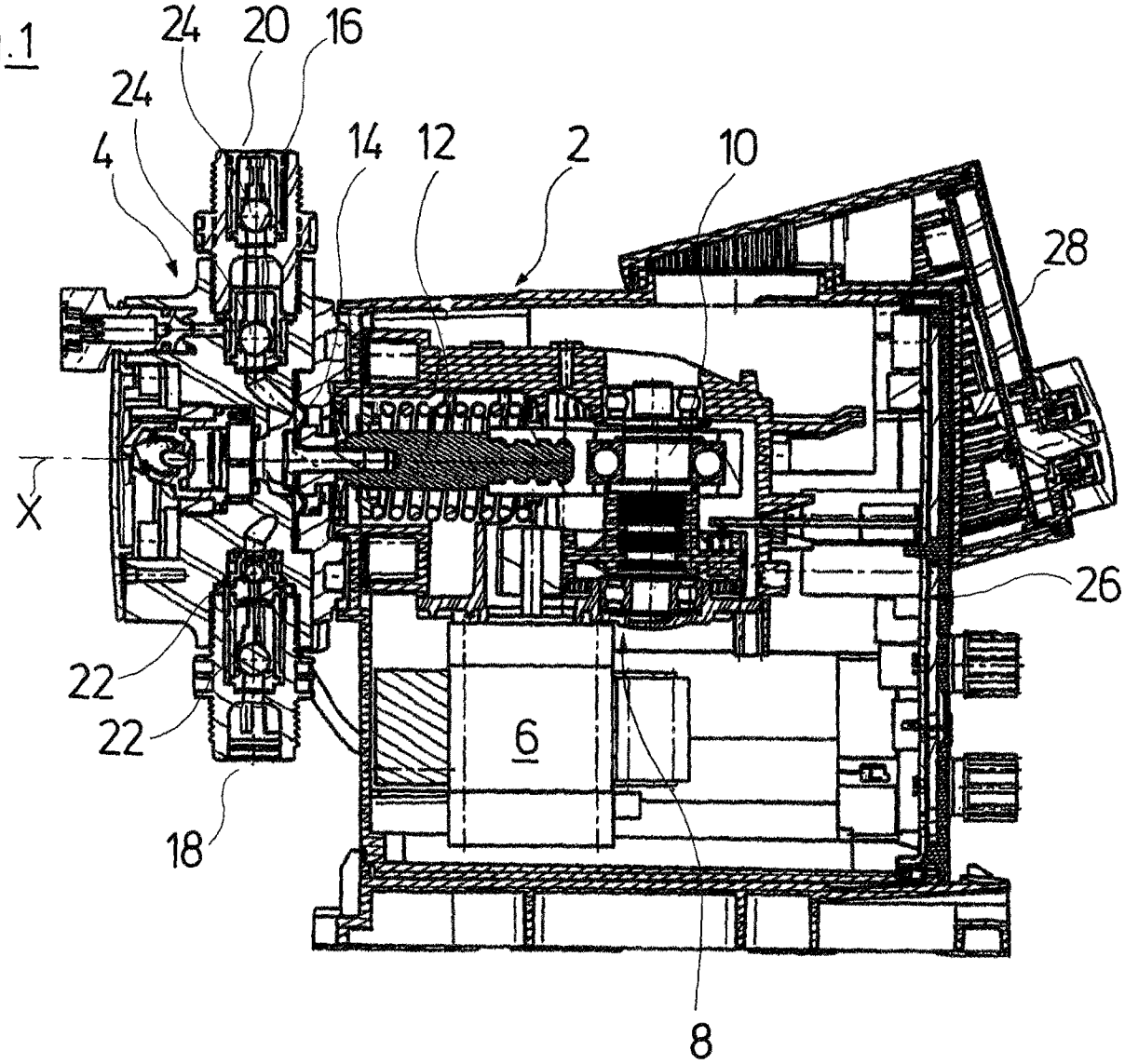
FIG. 1 is a sectional view of a metering pump aggregate according to the invention.

Referring to the drawings in particular, the metering pump aggregate according to the invention has a drive casing 2, the face of which accommodates a pump head 4. The drive casing 2 incorporates a positive-displacement drive in the form of an electric drive motor 6, which is preferably designed as a stepping motor. The drive motor 6 uses a gearing 8 to drive a cam 10. The cam 10 converts the rotating drive motion of the drive motor 6 into a linear motion of a connecting rod 12. The connecting rod 12 triggers a stroke motion of the membrane 14 in the pump head 4 in the direction of the stroke axis X. The membrane 14 borders one side of the metering chamber 16, and forms a positive-displacement body in the latter, with which the volume of the metering chamber 16 can be varied for pumping or metering purposes. The metering chamber 16 is connected with an intake port 18 and a pressure port 20. In the flow path for the intake port 18 in the metering chamber 16, two check valves 22 are arranged in series in the intake channel. Accordingly, two check valves 24 are arranged in series in the pressure channel, in the flow path from the metering chamber 16 to the pressure port 20. Two respective check valves 22 and 24 are here provided. However, it is to be understood that it is possible to use only one check valve 22 and one check valve 24.

In addition, the motor casing 2 incorporates a controller or electronic control system 26 that is connected with an operating and display unit 28, which can be used to set parameters, such as the conveyed flow, and read information output by the electronic control system 26. A specific conveyed flow, for example one that is set via the operating and display unit 28, is converted by the electronic control system 26 into a corresponding actuation or regulation of the drive motor 6, so that the latter is operated at a corresponding speed, thereby moving the membrane 14 in the direction of the stroke axis X at a corresponding stroke rate. The stroke length can also be controlled from the electronic control system 26 via the rotational angle of the drive motor 6, which is preferably designed as a stepping motor.

The problem when very low conveyed flows are selected is that the check valves 22 might not immediately close completely in the intake channel at the beginning of the pressure stroke, which can result in leaks that impair the metering accuracy. In order to prevent this, the electronic control system 26 is designed or programmed in such a way as to use a special drive characteristic to initiate closure of the valves 22, 24 given conveyed flows lying under a specific limit stored in the electronic control system 26. The corresponding limit can depend on the characteristics, size and special configuration of the pump head 4, and in particular of the check valves 22 and 24. Even if it is preferred that these special drive characteristics described below can be used for low conveyed flows under a specific limit, let it be understood that these drive characteristics could also be used for other conveyed flows.

Figure 2:
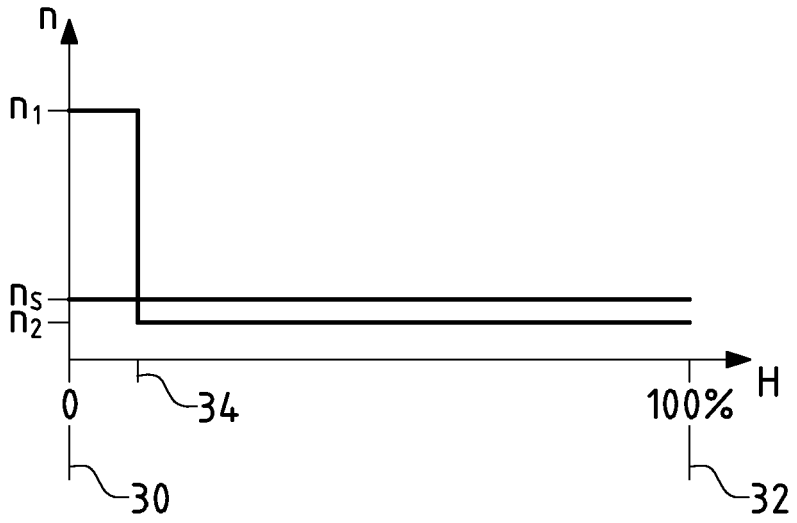
FIG. 2 is a diagram depicting the motor speed over the stroke length, the drive characteristics according to the invention for low conveyed flows.

The mentioned drive characteristic is described in greater detail based on FIG. 2. The latter presents a diagram showing the motor speed n of the drive motor 6 over the stroke length H of the pressure stroke. The point 30 in the diagram denotes when a pressure stroke starts, while the point 32 in the diagram indicates when the pressure stroke ends, at which time the full stroke length H of the membrane 14 in the direction of the stroke axis X has been reached. According to the special drive characteristics, the stroke is initiated at an elevated speed n1 of the drive motor 6. The electronic control system 26 actuates the drive motor 6 accordingly, so that it runs at this speed. Because of the gearing 8 and the cam 10, this causes a corresponding, proportional first, elevated stroke rate of the membrane 14 in the pressure stroke. The elevated stroke rate caused by the elevated speed n1 imparts a pulse or rapid pressure rise to the fluid in the metering chamber 16 at the beginning of the stroke, i.e., an elevated pressure, which brings about a tight, reliable closure of the intake-side check valve 22. The elevated speed n1 is maintained for a preset time that reflects a corresponding stroke length up to point 34 of the pressure stroke. The pressure stroke is then continued at a reduced speed n2 of the drive motor 6. As a result, this reduced speed n2 corresponds to a lowered stroke rate of the membrane 14 caused by the gearing 8 and the cam 10. This reduced speed n2 or reduced stroke rate is maintained until the end of the pressure stroke 32. The electronic control system 26 presets this reduced speed n2, which is proportional to a reduced stroke rate of the membrane 14, by correspondingly actuating the drive motor 6.

The electronic control system 26 selects the speeds n1 and n2 as a function of a prescribed setpoint speed ns. This setpoint speed ns is proportional to a setpoint stroke rate, which is in turn proportional to a setpoint conveyed flow, for example one that is prescribed by making an entry on the operating and display unit 28. The proportional setpoint speeds at which the drive motor 6 must be driven can be stored in a memory of the electronic control system 26 for corresponding setpoint conveyed flows, or be calculated and updated by the electronic control system 26. In addition, the corresponding elevated speed n1 to be selected, which is proportional to an elevated, first stroke rate, and the correspondingly reduced drive speed n2, which is proportional to a second, reduced stroke rate of the membrane 14, can be stored for specific setpoint conveyed flows for the drive characteristics specially shown here, as can the duration of the partial stroke with the elevated speed n1. As an alternative, these speeds n1 and n2 can be calculated and updated based on the algorithms stored in the electronic control system 26.

The stroke length 34 or duration for which the membrane 14 is operated at the first elevated stroke rate or drive motor 6 is operated at the first elevated speed n1, the level of the first speed n1 and the level of the second speed n2, which correspond to a first, elevated stroke rate and a second, lower stroke rate of the membrane 14, are set by the electronic control system 26 in such a way as to achieve, on average, the desired setpoint conveyed flow to which the setpoint speed ns of the motor 6 corresponds over the entire stroke length 32. This ensures that the elevated initial speed n1 on average will not cause an elevated quantity to be metered throughout the entire pressure stroke 32. By comparison to metering at a constant stroke rate, the quantity remains constantly proportional to the setpoint speed ns. The selected stroke length 34 that takes place at the elevated stroke rate, i.e., at the elevated speed n1, is also preferably small or short relative to the length of the entire stroke 32, so that an elevated conveyed flow arises for only a very short time at the beginning of the stroke, but is negligible in relation to the overall conveyed flow over the entire stroke length, while still leading to an elevated metering accuracy due to the improved closure quality of the check valves 22 and 24. The point 34 preferably corresponds to between 2 and 20% of the overall pressure stroke 32.

In the example shown here, only two speeds n1 and n2 are used in the course of the pressure stroke, wherein the speed changes suddenly in point 34. However, it would also be possible to change the speed in several steps or have it drop off slowly. Even when using several different speeds over the overall pressure stroke, they are preferably set in terms of magnitude and the duration for which use is made of these speeds, and hence the proportional stroke rates, in such a way as to achieve, on average, a desired setpoint conveyed flow over the entire stroke.

While specific embodiments of the invention have been shown and described in detail to illustrate the application of the principles of the invention, it will be understood that the invention may be embodied otherwise without departing from such principles.

The invention claimed is:

1. A metering pump arrangement comprising:

a metering chamber;

a positive-displacement drive;

a positive-displacement body that can be moved by the positive-displacement drive;

a check valve arranged on an intake side of said metering chamber;

a controller configured to control movement of the positive-displacement drive, the controller controlling the movement of the positive-displacement drive in such a way, at least for specific setpoint conveyed flows to be generated by the metering pump arrangement, that a pressure stroke of the positive-displacement body begins with a first, elevated stroke rate, and is immediately continued at a second, lower stroke rate and the pressure stroke of the positive-displacement body is finished with the second, lower stroke rate, wherein said check valve is closed by a pulse or pressure rise which is exerted on a medium to be conveyed at a beginning of said pressure stroke, wherein the controller actuates the positive-displacement drive in such a way for conveyed flows under a preset limit that the pressure stroke of the positive-displacement body begins with said first, elevated stroke rate, and is subsequently continued at said second, lower stroke rate, wherein the controller sets the first stroke rate and the second stroke rate along with a duration of a partial stroke at the first stroke rate so as to achieve an average conveyed flow over the entire pressure stroke that corresponds to at least one of the setpoint conveyed flows, wherein the first, elevated stroke rate is constant from a start of a beginning duration to an end of the beginning duration, the second, lower stroke rate being constant from a start of the second, lower stroke rate to an end of the pressure stroke of the positive-displacement body.

2. The metering pump according to claim 1, wherein the controller sets the first, elevated stroke rate to be faster than required for at least one of the setpoint conveyed flows, wherein the first, elevated stroke rate generates a first fluid flow output of the metering pump arrangement, the second, lower stroke rate generating a second fluid flow output of the metering pump arrangement, the first fluid flow output being greater than the second fluid flow output.

3. The metering pump according to claim 2, wherein the controller sets the second, lower stroke rate to be slower than required for at least one of the setpoint conveyed flows.

4. The metering pump according to claim 1, wherein 2% or more of the entire pressure stroke takes places at the first, elevated stroke rate.

5. The metering pump according to claim 1, wherein less than 20% of the entire pressure stroke takes place at the first, elevated stroke rate.

6. The metering pump according to claim 1, wherein the positive-displacement drive is operated at different speeds or different velocities by actuating the controller in order to change the stroke rate.

7. The metering pump according to claim 1, wherein the positive-displacement drive is a stepping motor.

8. A metering pump arrangement comprising:

a metering chamber;

a check valve provided on an intake side of said metering chamber;

a positive-displacement drive;

a positive-displacement body that is moved by the positive-displacement drive;

a controller configured to control movement of the positive-displacement drive to generate specific setpoint conveyed flows with a pressure stroke of the positive-displacement body having a first elevated stroke rate at a start of the pressure stroke and a subsequent second lower stroke rate immediately following the first elevated stroke rate and an end of said pressure stroke of the positive-displacement body is operated at said subsequent second lower stroke rate such that said check valve is closed by a pulse or pressure rise which is generated based on said first elevated stroke rate and exerted on a medium to be conveyed at a beginning of said pressure stroke, said controller being further configured to control the movement of the positive-displacement drive such that the positive-displacement body is operated at said first elevated stroke rate at a beginning duration of the pressure stroke and the positive-displacement body is operated at said subsequent second lower stroke rate for a remaining duration of the pressure stroke, wherein the controller sets the first stroke rate and the second stroke rate along with a duration of a partial stroke at the first stroke rate so as to achieve an average conveyed flow over the entire pressure stroke that corresponds to at least one of the setpoint conveyed flows, wherein the positive-displacement drive is operated at different speeds or different velocities by correspondingly actuating the controller in order to change the stroke rate, the first elevated stroke rate being constant during an entirety of said beginning duration of said pressure stroke, said second stroke rate being constant during an entirety of said remaining duration of said pressure stroke.

9. The metering pump according to claim 8, wherein the controller actuates the positive-displacement drive to generate conveyed flows under a preset limit with said pressure stroke of the positive-displacement body having said first elevated stroke rate and said subsequent second lower stroke rate, wherein the first elevated stroke rate generates a first fluid flow output of the metering pump arrangement, the second lower stroke rate generating a second fluid flow output of the metering pump arrangement, the first fluid flow output being greater than the second fluid flow output.

10. The metering pump according to claim 8, wherein:

2% or more of the entire pressure stroke takes place at the first elevated stroke rate; and less than 20% of the entire pressure stroke takes place at the first elevated stroke rate.

11. A metering pump arrangement comprising:

a metering chamber;

a check valve arranged on one side of said metering chamber;

a positive-displacement drive;

a positive-displacement body that is moved by the positive-displacement drive;

a controller configured to control movement of the positive-displacement drive to generate specific setpoint conveyed flows with a pump stroke of the positive-displacement body such that a beginning of a compression stroke of said pump stroke has a first stroke rate to generate a pulse or pressure rise exerted on a medium to be conveyed at said beginning of said compression stroke and an end of said compression stroke has a second stroke rate, said first stroke rate being greater than said second stroke rate, said check valve being closed via said pulse or pressure rise exerted on said medium to be conveyed, wherein said controller is further configured to control the movement of the positive-displacement drive such that the positive-displacement body is operated at said first stroke rate for a beginning duration of the compression stroke and the positive-displacement body is operated at said second stroke rate immediately after said first stroke rate ends for a remaining duration of the compression stroke until said end of said compression stroke is reached, said first stroke rate being constant during an entirety of said beginning duration of said compression stroke, said second stroke rate being constant during an entirety of said remaining duration of said compression stroke.

12. The metering pump according to claim 11, wherein the compression stroke comprises a first partial pressure stroke and a second partial pressure stroke, said first partial pressure stroke starting at said beginning of the compression stroke, said second partial pressure stroke beginning immediately after said first partial pressure stroke ends and continuing to said end of said pressure stroke, said controller being further configured to control the movement of the positive-displacement drive such that the positive-displacement body is operated at said first stroke rate during said first partial pressure stroke and the positive-displacement body is operated at said second stroke rate during said second partial pressure stroke, wherein said controller sets said first stroke rate and said second stroke rate such that an average conveyed flow over the entire pressure stroke corresponds to at least one setpoint of conveyed flows.

13. The metering pump according to claim 11, wherein said compression stroke corresponds to a part of said pump stroke during which said medium is conveyed out of the metering chamber of the metering pump arrangement and pressure inside said metering chamber is increasing, wherein said compression stroke creates said pulse or pressure rise inside said metering chamber such that said check valve is completely closed on a suction side of said check valve, wherein said first stroke rate generates a first fluid flow output of said metering pump arrangement, said second stroke rate generating a second fluid flow output of said metering pump arrangement, said first fluid flow output being greater than said second fluid flow output, said controller setting said first stroke rate and said second stroke rate such that an average conveyed flow over said entire pressure stroke that corresponds to at least one of said setpoint conveyed flows.

* * * * *